United States Patent [19]

Van den Houte et al.

[11] 3,998,636

[45] Dec. 21, 1976

[54] PRODUCTION OF A PERMANENT CONDUCTIVITY PATTERN

[75] Inventors: Jozef Willy Van den Houte; Yvan Karel Gilliams, both of Berchem; Pierre Richard De Roo, Schoten, all of Belgium

[73] Assignee: Agfa-Gevaert N.V., Mortsel, Belgium

[22] Filed: Feb. 21, 1975

[21] Appl. No.: 551,664

[30] Foreign Application Priority Data

Feb. 22, 1974 United Kingdom ..... 8237/74

[52] U.S. Cl. ..... 96/1.4; 96/1.5; 96/1.6; 96/90 R

[51] Int. Cl.[2] ..... G03G 5/06; G03G 13/22

[58] Field of Search ..... 96/1.4, 1.5, 1.5 C, 96/1.6, 90 R

[56] References Cited

UNITED STATES PATENTS

| | | | |
|---|---|---|---|
| 3,113,022 | 12/1963 | Cassiers et al. | 96/1.5 |
| 3,451,811 | 6/1969 | Brynko | 96/1 R |
| 3,525,612 | 8/1970 | Holstead | 96/1.5 X |
| 3,600,169 | 8/1971 | Lawton | 96/1.5 |
| 3,765,883 | 10/1973 | Endo et al. | 96/1.6 |
| 3,879,197 | 4/1975 | Bartlett et al. | 96/1 R |

*Primary Examiner*—Thomas J. Herbert, Jr.
*Attorney, Agent, or Firm*—William J. Daniel

[57] ABSTRACT

A recording material suited for the photographic production of a conductivity pattern, wherein said material contains a recording layer applied to the surface of a support the surface resistance of which is at least 100 times as small as that of the recording layer and wherein said recording layer contains in intimate admixture:

i. at least one ultraviolet radiation-sensitive organic polyhalogen compound from which photolytically halogen-containing free radicals can be separated,
ii. a photoconductive polymer containing N-vinylcarbazole units and
iii. as sensitizing agent increasing the conductivity of the recording layer during its photo-exposure an acylamino compound corresponding to the following general formula:

$$R_1 - CO - NH - R_2$$

wherein:

$R_1$ represents an alkyl group or a cycloalkyl group, and $R_2$ represents an aromatic group.

7 Claims, No Drawings

PRODUCTION OF A PERMANENT CONDUCTIVITY PATTERN

The present invention relates to a recording process and recording material for forming visible images through the production of a permanent conductivity pattern.

From the U.S. Pat. No. 3,451,811 an imaging process is known in which a recording material comprising an organic photochromic material, the molecules of which exhibit a change in electrical conductivity upon exposure to electromgnetic radiation and a conversion of one photochromic state to another, is exposed image-wise to said radiation and subjected to electrostatic charging whereby in the non-exposed area an electrostatic charge pattern is built-up that is developed with an electroscopic marking material to form a visible image. Additional duplicate images are formed without re-exposure by merely charging, developing and transfer of the image-wise deposited marking material.

From the U.S. Pat. No. 3,113,022 an electrophotographic copying process is known which comprises the steps of exposing an uncharged layer consisting essentially of at least one organic polymeric photoconductive insulating substance e.g. poly-N-vinylcarbazole and a diazonium salt uniformly distributed therethrough, image-wise to electromagnetic radiation to which said layer is sensitive, whereby a latent conductivity image is produced in said layer, subjecting said layer in absence of electromagnetic radiation to which said layer is sensitive to an electric field to create in said layer a pattern of electrostatic charges and developing said pattern of electrostatic charges with electrostatically attractable material.

Further from the published Japanese Patent Application No. 30,216/72 a process for the production of a master containing a conductivity pattern for electrostatic printing purposes is known in which process the light-sensitive layer of the master consisting of a photoconductive compound e.g. poly-N-vinyl carbazole, an organic polyhalogen compound and a sensitizing colour forming component, e.g. carbazole, is first image-wise exposed to ultra-violet radiation in order to decompose the organic polyhalogen compound. The obtained coloured product in the exposed portions serves in a second but overall exposure to visible light as a sensitizing agent for the increase of the conductivity of the originally image-wise exposed portions of the recording layer. So, two exposures are applied to form the final conductivity image of the master.

Said prior art methods have advantages over electrophotographic processes using photoconductive layers that have to be charged non-differentially before the image-wise exposure. Indeed, additional duplicate images can be formed without re-exposure since the conductivity pattern is permanent. A further advantage resides in the grainless structure of the obtained conductivity pattern since the photosensitive compound is present in the recording layer in molecularly divided form.

It is an object of the present invention to provide a recording process for producing an electostatic printing master with an improved permanent conductivity pattern.

It has now been found that said object is accomplished by 1. providing a recording material containing a recording layer that is optionally self-supporting and wherein in intimate admixture are present:
   i. at least one ultraviolet radiation-sensitive organic polyhalogen compound from which photolytically halogen-containing free radicals can be separated,
   ii. a photoconductive polymer containing N-vinylcarbazole units, and
   iii. as sensitizing agent increasing the conductivity of the recording layer during its photo-exposure an acylamino compound corresponding to the following general formula:

$$R_1 - CO - NH - R_2$$

wherein:

$R_1$ represents an alkyl group including a substituted alkyl group, or cycloalkyl group preferably a lower alkyl group such as a $C_1$–$C_5$ alkyl group, or a mercapto-substituted alkyl group e.g. a mercaptomethyl group ($HS—CH_2—$), and $R_2$ represents an aromatic group including a substituted aromatic group e.g. a phenyl group, 2. information-wise exposing the recording material to activating electromagnetic radiation increasing the conductivity of the exposed portions of the recording layer, 3. subjecting the exposed recording layer to uniform electrostatic charging, while the rear-side of the recording layer stands in contact with a conductive backing that allows the charges penetrating into the photo-exposed areas to leak off, 4. developing the electrostatic charge pattern that corresponds with the non-photo-exposed areas of the recording layer with an electrostatically attractable material, and 5. transferring the image-wise deposited electrostatically attractable material to a receiving material and optionally repeating the charging, developing and transfer steps at least once.

Specific examples of useful sensitizing agents according to the above general formula listed in the following Table 1.

Table 1

| Number of the compound | Structural formula | Melting point °C | Reference for preparation |
|---|---|---|---|
| 1 | 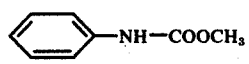 | 150 | Ber.60, 219 (1927) |
| 2 | 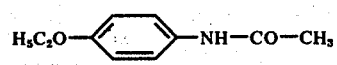 | 135 | Arch.der Pharmazie (1926) 324 |

Table 1-continued

| Number of the compound | Structural formula | Melting point °C | Reference for preparation |
|---|---|---|---|
| 3 | 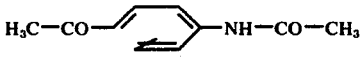 | 166 | Rec.Trav. Chim.41,659 (1922) |
| 4 | 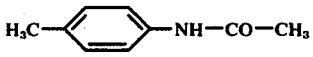 | 147 | Monatsh.48, 128 |
| 5 | 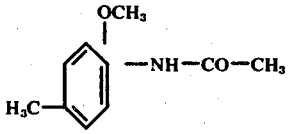 | 130 | Ber.42,3103 (1909) |
| 6 | 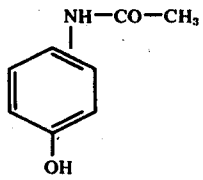 | 168 | J.Prakt.Chem. [2] 84,530 (1911) |
| 7 | 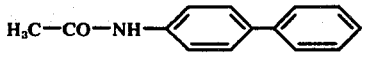 | 170 | Ann.260,234 (1890) |
| 8 | 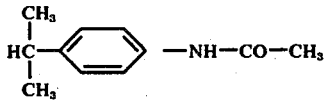 | 102 | Ber.21,1159 (1888) |
| 9 | 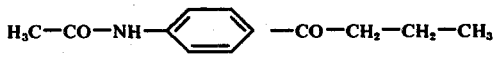 | 142 | Ber.33,2643 (1900) |
| 10 | 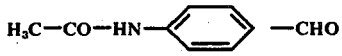 | 156 | Ber.16,2003 (1883) |
| 11 | 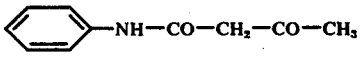 | 86 | Helv.Chim. Acta 11,779 |
| 12 | 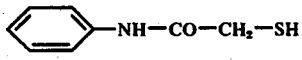 | 111 | J.Prakt.Chem [2] 84,649 (1911) |
| 13 | 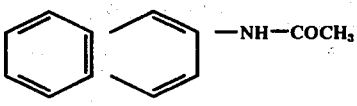 | 132 | J.Chem.Soc. 1926, 8 |

Organic polyhalogen compounds that are suited for use according to the present invention are sensitive to ultraviolet radiation and capable of photolytically separating a halogen-containing free radical.

Preferred photosensitive polyhalogen compounds are within the scope of the following general formula:

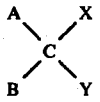

wherein:

each of A, B, X and Y is a halogen atom of the group of chlorine, bromine or iodine, or wherein one of said symbols A, B, X or Y represents an alkyl group, including a substituted alkyl group e.g. a halogensubstituted alkyl group, a hydroxyalkyl group or an aralkyl group e.g. benzyl, an aryl group, a substituted aryl group or an aroyl group, and the other symbols chlorine, bromine or iodine, or wherein at least two of said symbols A, B, X or Y represent an aromatic acyl group, e.g. benzoyl, and the other symbols chlorine, bromine or iodine.

Suitable representatives falling within the scope of that general formula are organic halides such as carbon tetrabromide, bromoform, iodoform, hexachloroethane, hexabromoethane, pentabromoethane, 1,1,2,2-tetrabromoethane, $\alpha,\alpha,\alpha$-tribromoacetophenone and tribromoethanol.

According to a preferred embodiment of the present invention the recording layer contains a N-vinylcarbazole homopolymer in a quantity sufficient to serve as binder for the organic polyhalogen compound and acylamino sensitizing agent.

Suitable N-vinylcarbazole homopolymers and copolymers can be prepared by application of one of the various known polymerization procedures, e.g. by pearl- or emulsion polymerization or by polymerization in solution, whereby the initiation of the polymerization can occur with free radicals, by ion formation, or by radiation, e.g., with actinic light. It is to be noted that the polymerization degree is not critical and may vary between wide limits. As far as the copolymers are concerned it is further to be noted that the content of N-vinylcarbazole units may vary between wide limits, say, e.g. between 20 and 95%. In general, the best results are attained with copolymers having a content of vinylcarbazole units between 40 and 90%.

The preparation of suitable poly-N-vinylcarbazoles is described, e.g., in the German Patent Specifications 931,731 filed Mar. 4, 1953, 936,421 filed Feb. 20, 1953, 1,097,680 filed Oct. 15, 1959 all three by Badische Anilin- & Soda-Fabrik A.G., and 1,158,367 filed July 18, 1962 by Gevaert Photo-Producten N.V. and the U.S. Pat.Specification No. 2,072,465 of W. Reppe, E. Keyssner and E. Dorrer, issued Mar. 2, 1937.

The preparation of suitable N-vinylcarbazole copolymers is described in the United Kingdon Patent Specification 964,875 filed Apr. 21, 1960 by Gevaert Photo-Producten N.V.

Halogen-substituted poly-N-vinylcarbazoles are described in the published Japanese Patent Applications 21,875/67 filed June 18, 1964, 25,230/67 filed Oct. 13, 1964, 7,592/68 filed Nov. 27, 1964, 19,751/67 filed June 18, 1964 and 7,591/68 filed Nov. 18, 1964 all by Matsushita Electric Industrial Co. Ltd.

For illustrative purposes suitable vinyl copolymers containing N-vinylcarbazole units are enumerated in the following Table 2.

Table 2

| Copolymer | mole % of N-vinyl-carbazole |
|---|---|
| copolymer of N-vinylcarbazole and vinylidene chloride | 85.4 |
| copolymer of N-vinylcarbazole and 3,3',5-vinyl trimethyl isononylether | 93 |
| copolymer of N-vinylcarbazole and vinyl acetate | 88.6 |
| copolymer of N-vinylcarbazole and isopropenyl acetate | 94.5 |
| copolymer of N-vinylcarbazole and vinyl stearate | 37.5 |
| copolymer of N-vinylcarbazole and methyl acrylate | 67.6 |
| copolymer of N-vinylcarbazole and ethyl acrylate | 41 |
| graft copolymer of N-vinylcarbazole and ethyl acrylate | 90.3 |
| emulsion polymer of N-vinylcarbazole and polyethylacrylate | 94.5 |
| copolymer of N-vinylcarbazole and n-butyl acrylate | 58.3 |
| copolymer of N-vinylcarbazole and 2-ethyl hexylacrylate | 51.6 |
| copolymer of N-vinylcarbazole and acryloxy-ethyldiethylamine | 76.6 |
| copolymer of N-vinylcarbazole and vinyl cinnamate | 92.5 |
| copolymer of N-vinylcarbazole and methyl methacrylate | 62.7 |
| copolymer of N-vinylcarbazole and isobutyl methacrylate | 51.8 |
| copolymer of N-vinylcarbazole and lauryl methacrylate | 77.4 |
| copolymer of N-vinylcarbazole and methylacryl-oxyethyldiethylamine | 9.7 |
| copolymer of N-vinylcarbazole and acrylonitrile | 88 |
| graft copolymer of N-vinylcarbazole and butyl-aldehyde acetal of polyvinylalcohol | 30 |
| copolymer of N-vinylcarbazole and di(2-di-chloroethyl)-vinyl phosphonate | 82.4 |
| copolymer of N-vinylcarbazole and styrene | 49 |
| graft copolymer of N-vinylcarbazole and poly-styrene | 27.3 |
| copolymer of N-vinylcarbazole and vinylnaphtha-lene | 47.1 |
| copolymer of N-vinylcarbazole and anthracene-(9,10) | 91.5 |
| copolymer of N-vinylcarbazole and 2-vinylpy-ridine | 31.8 |
| copolymer of N-vinylcarbazole and 4-vinyl-pyridine | 32.4 |
| copolymer of N-vinylcarbazole and N-vinyl-pyrrolidine | 69.1 |
| terpolymer of N-vinylcarbazole, acrylonitrile, and styrene | 20 |
| graft copolymer of a terpolymer of vinyl chlo-ride, vinyl acetate, and vinyl alcohol with N-vinylcarbazole | 29.4 |
| graft copolymer of a terpolymer of vinyl chloride, vinyl acetate, and maleic anhydride with N-vinylcarbazole | 55.1 |

The recording material of the present invention preferably contains the photosensitive polyhalogen compound and acylamino sensitizing compound in a layer whose binder is solely poly-N-vinylcarbazole. However, minor amounts of other binding agents are not excluded and so recording layers of the present invention may contain also hydrophobic polymers and copolymers e.g. on the basis of styrene, vinyl acetate, acrylonitrile, acrylic acid ester, methacrylic acid ester or butadiene units, hydrophobic cellulose derivatives, phenoxy resins or polycondensates of the polyester type, e.g. polycarbonates.

A dry photographic coating containing the above mentioned ingredients may be formed by dissolving the ingredients in a suitable inert solvent and which is removed from the coating composition by evaporation so that a solid photographic recording layer on a properly chosen support is left. The supports may be of any kind encountered in electrophotography.

The photographic coatings for use according to the present invention have preferably a thickness in dry condition of about 0.003 mm to about 0.025 mm.

The amount of photosensitive polyhalogen compound with respect to the polymer containing N-vinylcarbazole units may vary within a broad range but preferably the photosensitive polyhalogen compound is present in the recording layer in a weight ratio of abut 1:2 with respect to said polymer.

Useful results in conductivity increase are obtained with an acylamino sensitizing agent in a ratio by weight range from about 1 to 25 to about 1 to 2 with respect to the N-vinylcarbazole polymer.

Preferred compositions contain an amount of acylamino compound in a ratio by weight of 1:10 with respect to the N-vinylcarbazole polymer.

In the recording process of the present invention the recording material is preferably exposed with ultraviolet radiation or a light source emitting white light and ultraviolet radiation.

Suitable light sources for use in the exposure of the recording materials of the present invention are high pressure mercury vapour ultraviolet radiation sources, xenon lamps, flash lamps, and also daylight.

The image-wise exposed recording layer is subjected to an overall corona-charging treatment. During said charging the recording layer stands through its rear side in contact with a conductive body allowing the discharge of the applied corona charge in the previously photoexposed portions of the recording layer. For that purpose the rear side of the recording layer is held in contact with or the recording layer is applied to a conductive support or support that has been coated with an electrically conductive interlayer.

Suitable supports for recording materials according to the present invention are e.g. electro-conductive plates or sheets preferably having an electrical resistivity at least 100 times as small as that of the recording layer in the dark. Preference is given to supports whose surface resistance does not exceed $10^7$ Ω per sq.cm.

Examples of suitable supports are conductive plates e.g. plates of metals such as aluminum, zinc, copper, tin, iron, or lead.

Too highly insulating supports may be provided with a conductive subbing layer or interlayer.

Suitable electro-conductive interlayers for insulating supports are, e.g., vacuum-coated metal and conductive metal compound (metal oxide or metal salt) layers such as silver, tin, aluminium, titanium dioxide and copper iodide conductive layers, transparent conductive polymer layers, e.g. applied from polymers containing quaternized nitrogen atoms, such as those described in the United Kingdon Patent Specification 950,960, or layers containing conductive particles, e.g. carbon black and metal particles dispersed in a binder. The binder used for said particles has a resistivity preferably lower than $10^6$ Ω.cm. A suitable binder for that purpose is gelatin.

Paper sheets that have an insufficient electrical conductivity are coated or impregnated with substances enhancing their conductivity, e.g. by means of a conductive overcoat such as a metal sheet laminated thereto.

As substances suited for enhancing the conductivity of a paper sheet and which can be applied in the paper mass are particularly mentioned hygroscopic compounds and antistatic agents as described, e.g., in the United Kingdom Patent Specification No. 964,877, and antistatic agents of the polyionic type, e.g. CALGON CONDUCTIVE POLYMER 261 of Calgon Corporation, Inc., Pittsburgh, Pa., U.S.A., provided as a solution containing 39.1% by weight of active conductive solids, on the basis of a conductive polymer having recurring units of the following type:

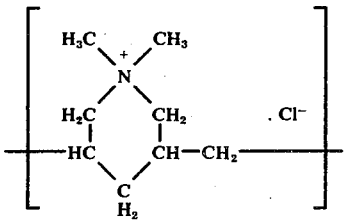

The applied paper sheets are preferably impermeabilized to organic solvents, e.g. by means of a water-soluble colloid or by strongly hydrating the cellulose fibers such as in glassine paper.

In the present invention the use of self-supporting photoconductive sheets is not excluded. These sheets may be coated at the rearside with a conductive layer applied e.g. by vacuum-evaporation of metal(s).

The development of the electrostatic charge image obtained on the layer containing the conductivity pattern proceeds e.g. by dusting the plate or sheet bearing the electrostatic image with finely divided solid particles that are image-wise electrostatically attracted or repulsed so that a powder image in conformity with the charged and non-charged areas respectively is obtained.

Well-established methods of dry development of the electrostatic latent image include cascade, powder-cloud, magnetic brush, and fur-brush development. These are all based on the presentation of dry toner to the surface bearing the electrostatic image where coulomb forces attract or repulse the toner so that it settles in the electrostatically charged or uncharged areas. The toner itself preferably has a charge applied by triboelectricity.

The powder deposit forming the developed image is transferred from the layer carrying the electrostatic charge image to a receptor sheet e.g. paper sheet or film e.g. a transparent resin film. Any known process for transferring the powder of the powder image from one support to another may be used; such powder transfer processes are well known in the art of electrophotography. If an electrostatically attractable powder is used, the powder image can be transferred by electrostatic attraction, e.g. according to the method disclosed in the United Kingdon Patent Specification No. 658,699. If a powder with ferro-magnetic properties is used for developing the electrostatic latent image, the powder may be transferred by magnetic attraction.

The present invention, however, is not restricted to the use of dry toner. Indeed, it is also possible to apply a liquid development process (electrophoretic development) according to which dispersed particles are deposited by electrophoresis from a liquid medium. In that case the recording element bearing the electrostatic charge pattern is preferably smooth (non-porous) and possesses only a weak adhesion with respect to the electrophoretically deposited toner particles so that these particles after evaporation of the developing liquid can be transferred easily. Organic polymeric photoconductive recording layers are particularly suited for that purpose.

The present invention is illustrated by the following example, without, however, limiting it thereto. The ratios and percentages are by weight when not otherwise indicated.

EXAMPLE

A recording layer suited for the production of a conductivity image was prepared by coating on an aluminium sheet support a solution consisting of:

| | | |
|---|---|---|
| trichloroethylene | 5 | ml |
| 1,2-dichloro-ethane | 5 | ml |
| carbon tetrabromide | 0.25 | g |
| compound 1 of Table 1 | 0.6 | g |
| poly-N-vinylcarbazole | 0.5 | g |

The dried recording layer had a thickness of 0.15 mm.

The recording layer was image-wise exposed through a transparent graphic original with ultraviolet radiation and visible light emitted by xenon lamp.

The thus exposed sheet was braced on an aluminium drum replacing the photoconductive selenium drum in the GEVAFAX X-10 office coper. (GEVAFAX is a trade name of Agfa-Gevaert N.V. Belgium). The copier has been described in detail in the article of K. H. Ardndt "Wie funktioniert ein elektrophotographischer Kopierautomat" — Photo-Technik and Wirtschaft Nr.6 (1971) page 191.

The exposed recording layer was subjected to negative corona charging the corona wires having a voltage of −6000 V with respect to the ground.

The non-photo-exposed recording layer portions obtained a negative charge. The charge pattern was powder-developed in said copier and the powder image transferred to plain paper.

The surface resistance (Ohms per square cm) of the recording layer before the photo-exposure was larger than $4.3 \times 10^{13}$, after the photo-exposure it was dropped to $4.3 \times 10^{7}$ Ohm per sq.cm.

On replacing in the recording layer composition the applied amount of compound 1 of Table 1 by 0.56 g of compound 12 still better conductivity pattern results were obtained viz. before photo-exposure the surface resistance of the recording layer was larger than $4.3 \times 10^{13}$ Ohm per sq.cm and after the photo-exposure only $2.8 \times 10^{7}$ ohm per sq.cm.

Powder images of good quality were obtained likewise by applying a negative corona charging with a lower potential difference than −6000 V e.g. in the range of −2000 to −6000 V.

We claim:

1. An electrophotographic copying process which comprises the steps of:

1. providing a recording material including a recording layer containing an intimate admixture of:
   i. at least one ultraviolet radiation-sensitive organic polyhalogen compound from which photolytically halogen-containing free radicals can be separated,
   ii. a photoconductive polymer containing N-vinylcarbazole units, and
   iii. as a sensitizing agent for increasing the conductivity of the recording layer during its photo-exposure an acylamino compound corresponding to the following general formula:

$$R_1-\underset{\underset{O}{\|}}{C}-NH-R_2$$

wherein:

$R_1$ represents a $C_{1-5}$ alkyl or cycloalkyl group, and $R_2$ represents a phenyl or naphthyl group, 2. image-wise exposing the recording material to activating electromagnetic radiation increasing the conductivity of the exposed portions of the recording layer,
3. subjecting the exposed recording layer to uniform electrostatic charging, while the rear-side of the recording layer stands in contact with a conductive backing that allows the charges penetrating into the photoexposed areas to leak off,
4. developing the electrostatic charge pattern that corresponds with the non-photoexposed areas of the recording layer with an electrostatically attractable material, and
5. transferring the image-wise deposited electrostatically attractable material to a receiving material and optionally repeating the charging, developing and transfer steps at least once.

2. An electrophotographic copying process according to claim 1, wherein the only binder of the recording layer is poly-N-vinylcarbazole.

3. An electrophotographic copying process according to claim 1, wherein the photosensitive polyhalogen compound is carbon tetrabromide.

4. An electrophotographic copying process according to claim 1, wherein the acylamino compound is acetanilide.

5. An electrophotographic copying process according to claim 1, wherein the photosensitive polyhalogen compound is present in the recording layer in a weight ratio of about 1:2 with respect to the polymer containing N-vinylcarbazole units.

6. An electrophotographic copying process according to claim 1, wherein the acylamino compound is present in the recording layer in a ratio by weight range from about 1:25 to about 1:2 with respect to the polymer containing N-vinylcarbazole units.

7. An electrophotographic copying process according to claim 1, wherein the thickness in dry condition of the recording layer is in the range of about 0.003 mm to about 0.025 mm.

* * * * *